US007260353B2

(12) United States Patent
Takemura

(10) Patent No.: US 7,260,353 B2
(45) Date of Patent: Aug. 21, 2007

(54) IMAGE HEATING APPARATUS WITH HEATING NIP FOR PREVENTING IMAGE FAILURE

(75) Inventor: Taichi Takemura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 11/244,082

(22) Filed: Oct. 6, 2005

(65) Prior Publication Data

US 2006/0083561 A1 Apr. 20, 2006

(30) Foreign Application Priority Data

Oct. 20, 2004 (JP) ..... 2004-305793
Aug. 11, 2005 (JP) ..... 2005-233276

(51) Int. Cl.
*G03G 15/20* (2006.01)

(52) U.S. Cl. ..... 399/329

(58) Field of Classification Search ..... 399/329; 219/216

See application file for complete search history.

(56) References Cited

U.S. PATENT DOCUMENTS 7,155,155 B2 * 12/2006 Uehara et al. ..... 399/329
2002/0051659 A1 * 5/2002 Baba et al. ..... 399/307
2003/0183610 A1 * 10/2003 Okabayashi et al. ..... 219/216
2006/0083561 A1 4/2006 Takemura ..... 399/329

FOREIGN PATENT DOCUMENTS

| | | | |
|---|---|---|---|
| EP | 000707244 A1 * | 10/1995 | |
| JP | 11-2979 | 1/1999 | |
| JP | 11-45025 | 2/1999 | |
| JP | 11038802 A * | 2/1999 | |
| JP | 11045018 A * | 2/1999 | |
| JP | 2004-20641 | 1/2004 | |
| JP | 2004-69968 | 3/2004 | |

* cited by examiner

*Primary Examiner*—Quana Grainger
(74) *Attorney, Agent, or Firm*—Fitzpatrick, Cella, Harper & Scinto

(57) ABSTRACT

A belt nip type fixing apparatus, which prevents a formation of an icicle-like uneven glossiness occurring on a surface of a fixed image due to pressure release in a fixing nip. In addition, an image forming apparatus provided with the fixing apparatus for preventing an occurrence of image failure even in a case where a coated paper sheet, which is most likely to cause the image failure, is used as a recording material and for enlarging a scope of application of the recording material while maintaining a productivity, to thereby attain an improved merchantability. The apparatus is configured such that a wedge-shaped space, which is formed between a belt, a separation roller, and a pressure pad, is adequately filled by a sliding sheet, thereby preventing a pressure in the fixing nip from being decreased.

5 Claims, 12 Drawing Sheets

IMAGE HEATING APPARATUS WITH HEATING NIP FOR PREVENTING IMAGE FAILURE

BACKGROUND OF THE INVENTION

1. Field of the Invention

The present invention relates to an image heating apparatus for heating an image on a recording material, which is used for an image forming apparatus such as a copying machine, a printer, or a facsimile machine. Examples of the image heating apparatus include a fixing apparatus for fixing an unfixed image on a recording material and a glossiness increasing apparatus for increasing a glossiness of an image by heating the image fixed on a recording material.

2. Related Background Art

Conventionally, there has been a belt fixing apparatus in which a fixing roller and a belt are used, as described in Japanese Patent Application Laid-Open No. H11-045025.

In the belt fixing apparatus, it is possible to easily set a fixing nip width to be large along a direction of conveyance of the recording material by adjusting a contact width of the belt with respect to the fixing roller.

Therefore, the fixing nip width can be secured without depending on a diameter of the fixing roller, making it possible to reduce a diameter and a heat capacity of the fixing roller, to thereby shorten rise time of the belt fixing apparatus. That is, the belt fixing apparatus is capable of melting a large amount of toner. Therefore, the belt fixing apparatus is suitable for the image forming apparatus, which uses a large amount of toner such as a color image forming apparatus.

FIG. 9 is a schematic diagram of the belt fixing apparatus as described in Japanese Patent Application Laid-Open No. H11-045025 mentioned above. A fixing roller 51 is disposed such that the fixing roller 51 can be freely rotated. On a lower side of the fixing roller 51, a belt unit 53 is disposed.

Inside the fixing roller 51, a heater 58 such as a halogen lamp is disposed. In addition, a thermister (not shown) is disposed on the fixing roller 51. The thermister may be in contact with or out of contact with the fixing roller 51, and regulates a temperature of a surface of the fixing roller 51 by controlling a voltage supplied to the heater 58 via a temperature control circuit.

The belt unit 53 is provided with a fixing belt 52 which is a flexible endless belt; three rollers of a first roller 55, a second roller 56, and a third roller 57, which are plural winding and stretching members around which the fixing belt 52 is wound and stretched; a pressure pad 1000; and the like. The pressure pad 1000 is provided with a low friction sheet.

The separation roller 56 and the pressure pad 1000 are brought into pressure contact with the fixing roller 51 via the fixing belt 52, and thus a fixing nip portion N' which is a contact portion of the fixing roller 51 and the fixing belt 52 are formed with a width large in the direction of conveyance of the recording material.

FIG. 10 shows an example of a pressure distribution of the pressure of the fixing nip portion along the direction of conveyance of the recording material, and a curve A shows a case of a conventional belt fixing apparatus. A curve B shows an example of the pressure distribution of the fixing nip portion of the fixing apparatus using a conventional pair of rollers. A curve C shows a case in which in the conventional roller fixing type fixing apparatus, a thickness of an elastic member layer of the fixing roller is made to be thick and an amount of deformation of the elastic member layer is increased by increasing the pressurizing force with a pressure roller in order to increase a nip width without increasing an outer diameter of the fixing roller as less as possible.

The belt fixing apparatus has a merit in making a nip width W1 much wider than a nip width W2 of the roller fixing type fixing apparatus. A nip width W3 of the roller fixing type fixing apparatus is somewhat wider than the nip width W2 as shown in the curve B. However, an effect obtained by enlarging the nip width is small, and in addition, the thick elastic member layer causes a heat capacity to be large, which is disadvantageous in view of energy conservation.

In the belt fixing apparatus, the separation roller 56 and the pressure pad 1000 are separated from each other as shown in FIG. 9. The pressure between the separation roller 56 and the pressure pad 1000, however, is not zero, as is understood from the pressure distribution of the fixing nip portion as shown in the curve A of FIG. 10, and the pressure of the separation roller 56 and the pressure of the pressure pad 1000 are continuous to each other through a tension of the fixing belt 52.

In the belt fixing apparatus, however, when a recording material, such as a coated paper sheet, having a low air permeability is used, there is another problem in that a portion in which the glossiness is low (haze: hereinafter referred to as uneven glossiness), as shown in FIG. 11, is formed in an icicle-like shape on a solid image.

In other words, in a case where the recording material having a low air permeability such as a coated paper sheet is used, an image disturbance occurs due to an expansion of air or generation of steam inside the fixing nip. The expansion of air or the generation of water vapor is caused by the following reasons: that is, air existing in an unfixed toner layer stagnates in a portion A' in which the pressure in the nip is low, namely, a boundary region of the pressure pad and the separation roller; and the stagnated air partly forms an air gap on a boundary surface of the recording material and the fixing roller, and disturbs a toner image which is not completely fixed yet.

In a case where a plain paper sheet is used, the plain paper sheet has an air permeability higher than the air permeability of the coated paper sheet, so the air existing in the toner layer is retained within the plain paper sheet which is a porous member having a large capacity; or otherwise, the air escapes by passing the plain paper sheet. Therefore, it can be considered that the image disturbance does not often occur.

Further, in the case of a recording material having an especially low air permeability such as a thick coated paper sheet, a larger amount of air is likely to be stagnated in the portion A' in which the pressure is decreased. Therefore, the problem of occurrence of the uneven glossiness described above becomes more serious.

Note that under an environment of high humidity in which the air contains high moisture content, the problem like this noticeably occurs.

SUMMARY OF THE INVENTION

The present invention has an object to provide an image heating apparatus capable of controlling an image failure.

The present invention has another object to provide an image heating apparatus in which less pressure release occurs in a heating nip.

According to the present invention, there is provided an image heating apparatus including: a heat rotary member for heating an image on a recording material by a heating nip; an endless belt for forming the heating nip between the endless belt and the heat rotary member; a roller for pressing the endless belt in the heating nip toward the heat rotary member; a pad for pressing the endless belt in the heating nip toward the heat rotary member; and a sheet, which covers the pad and which is slidable on the endless belt, in which the image heating apparatus satisfies a relationship of:

$$0<S1/S0\leqq 0.25,$$

where a cross-section area of a space surrounded by the belt, the roller, and the pad is S0, and a cross-section area of a space surrounded by the belt, the roller, and the sheet is S1.

Further features of the present invention will become apparent from the following detailed description of exemplary embodiments with reference to the attached drawings.

DESCRIPTION OF THE PREFERRED EMBODIMENTS

Hereinafter, the present invention is more specifically explained by referring to embodiments of the present invention. Note that the embodiments are examples of best modes for carrying out the present invention, but the present invention is not limited only to various kinds of structures explained in the embodiments. In other words, the various kinds of structures of the present invention explained in the embodiments can be substituted by other known structures within a scope of thought of the present invention.

First Embodiment

Figure 3:
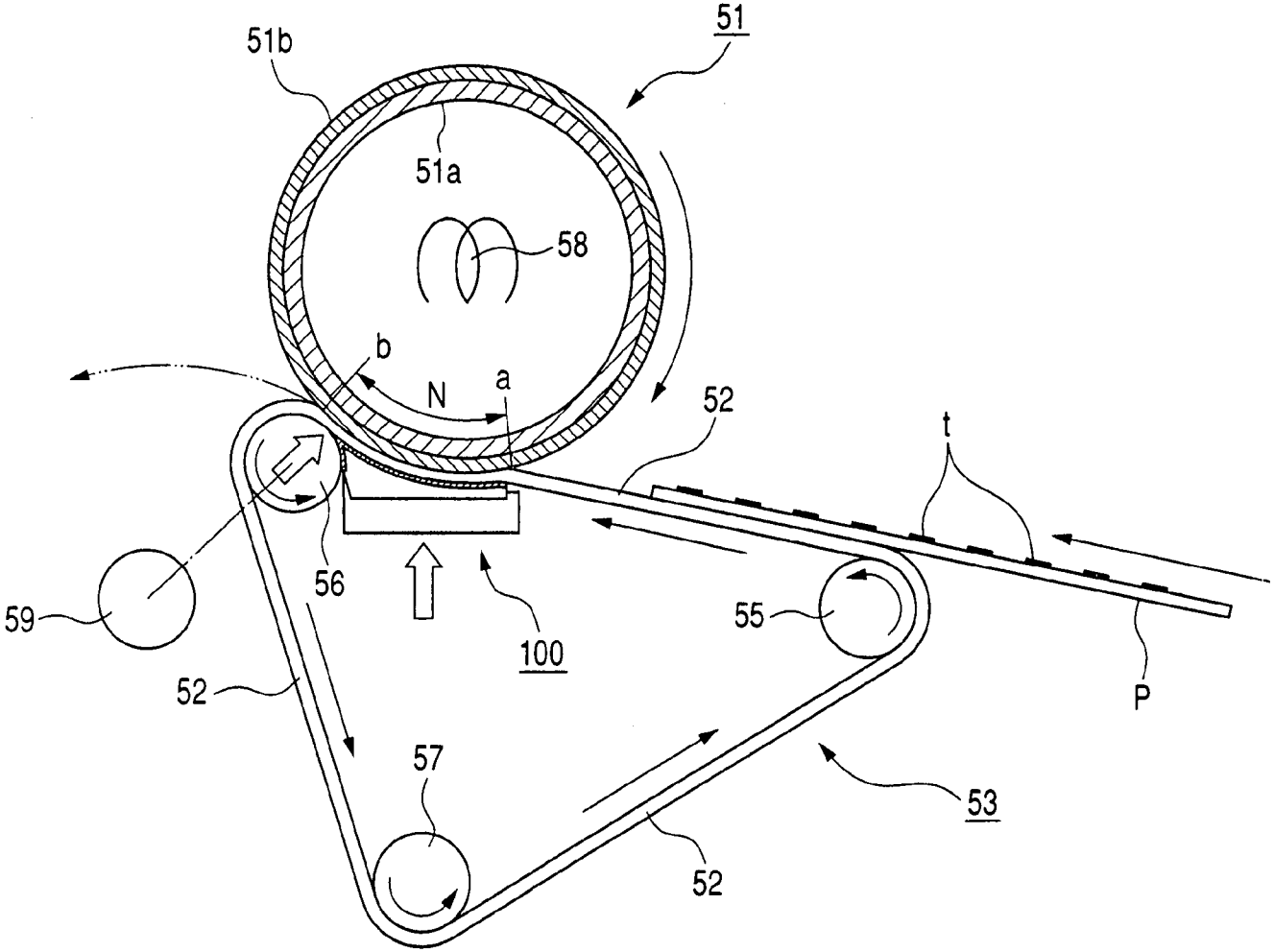
FIG. 3 is an explanatory view of a configuration of a fixing apparatus according to the first embodiment of the present invention.

FIG. 3 is an outline configuration diagram of a belt fixing apparatus, which is an image heating apparatus of this embodiment.

A fixing roller 51 which is a heat rotary member (fixing rotary member) is configured to have a metal core 51*a* made of Fe which has an inner diameter of ϕ37.8 mm, an outer diameter of ϕ38.4 mm, and a thickness of 0.3 mm. As an elastic layer 51*b*, a silicone rubber layer having a thickness of 0.5 mm is formed on the metal core 51*a*. A PFA tube having a thickness of 30 μm which is a releasing layer covers the elastic layer 51*b*. As a result, the fixing roller has the outer diameter of 40 mm.

A fixing belt 52, which is an endless belt, has a base layer of a thickness of 100 μm made of polyimide. The silicone rubber layer having a thickness of 0.2 mm covers the base layer. As a result, the outer diameter of the fixing belt 52 is ϕ90 mm. Note that the fixing belt of this embodiment is a seamless belt.

The fixing belt 52 is looped around three rollers of an entrance roller 55, a separation roller 56, and a tension roller 57. The group of rollers rotates in accordance with the belt. More specifically, the fixing belt rotates by a driving force applied to the separation roller 56 from a driving source. The entrance roller 55 and the tension roller 57 are driven and rotated by the belt.

The entrance roller 55 is a roller disposed on a side of the entrance through which a recording material advances into a fixing apparatus. The entrance roller 55 is fixed so that a conveyance path of the recording material is not changed. The tension roller 57 is biased by a spring so that a prescribed tension is applied to the fixing belt 52.

The separation roller 56 is a solid roller made from SUS. The fixing belt is stretched around the separation roller 56, which supports the fixing belt at the inner surface of the fixing belt in a most downstream position of a fixing nip, which is a heating nip.

The separation roller 56 pressurizes the fixing belt 52 toward the fixing roller 51 by a pressurizing mechanism (spring). At this time, the separation roller 56 is pressurized to the elastic layer 51*b* of the fixing roller 51 so that the fixing belt 52 inroads into the elastic layer 51*b*. As a result, in a portion in which the elastic layer of the fixing roller 51 is deformed, the recording material P is separated from the surface of the fixing roller 51 by a self stripping. In this embodiment, the outer diameter of the separation roller 56 is ϕ15 mm, and a total pressure of 392 N (40 kgf) is applied.

In addition, a pressure pad (pressurizing mechanism) 100 which is the pad (a pressure applying member) for applying pressure from the inner surface of the fixing belt toward the fixing roller is provided in order to form the fixing nip.

Figure 4A:
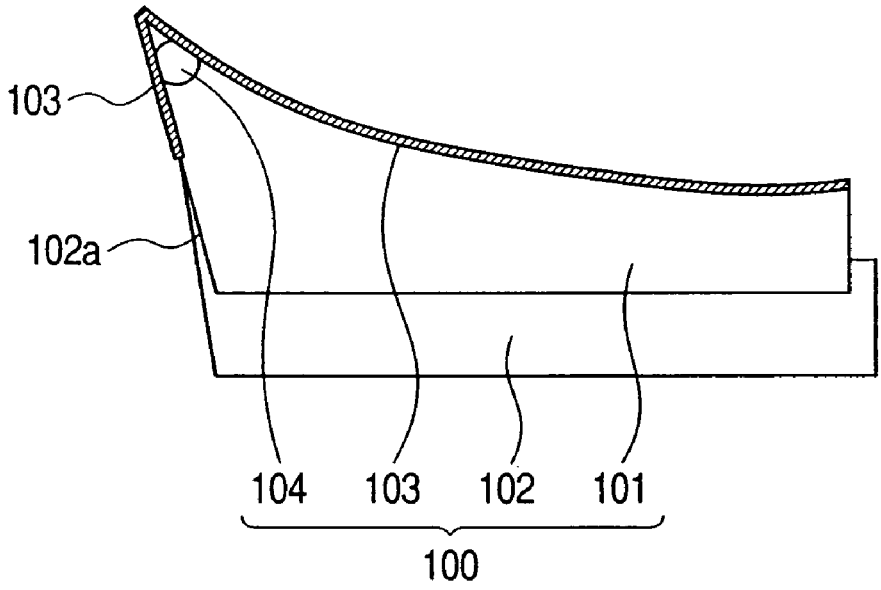
FIG. 4A and FIG. 4B are explanatory views of a configuration of a pressure applying member according to the first embodiment, a second embodiment, and a third embodiment of the present invention.

As shown in FIG. 4A, the pressure pad 100 is provided with a base plate 102 and an elastic layer 101 which is an elastic member laminated on the base plate 102. Further, the pressure pad 100 is provided with a rigid rod (wire) 104 which is a rod-shape member provided at an edge portion of the elastic layer 101 on a downstream side in the direction of conveyance of the recording material.

In order to alleviate a sliding resistance between the pressure pad 100 and the inner surface of the fixing belt, that is, in order to reduce the sliding resistance between the elastic layer 101 and the inner surface of the fixing belt, a sliding sheet (low friction sheet) 103 is provided so as to cover the elastic layer 101 including the portion of the rod 104.

The rod 104 according to the first embodiment is a metal rod having a diameter of 1.2 mm which is circular in cross section. A glass cloth sheet coated with PTFE is used as the sliding sheet 103, and the sliding sheet 103 is coated with silicone oil as a lubricant. In the first embodiment, the thickness of the sliding sheet 103 is 100 μm.

The pressure pad 100 mentioned above is pressed toward the fixing roller 51 by a spring (not shown) disposed on the base plate 102 side via the fixing belt 52.

Because the pressure pad 100 is provided with the elastic layer 101, a contacting surface of the sliding sheet 103 contacting a back surface of the fixing belt can be aligned with an outer peripheral surface of the fixing roller 51. That is, when the pressure pad 100 is pressed toward the fixing roller 51 by applying a load of a specific value or more, the elastic layer 101 is deformed and the contacting surface of the sliding sheet 103 is deformed into a shape conforming to an outer peripheral surface of the fixing roller 51. Therefore, when the pressure pad 100 is pressed to the fixing roller 51 by the spring (not shown) via the fixing belt 52, the fixing belt 52 comes into pressure contact with the fixing roller 51 without a clearance. In the first embodiment, a total pressure of 588 N (60 kgf) is applied to the pressure pad 100. Thus, the pressurizing force of 588 N of the pressure pad 100 and the pressurizing force of 392 N of the separation roller 56 add up to the total pressurizing force of 980 N (100 kgf). At this time, a maximum pressure at the pressure pad 100 in a fixing nip portion N is set to be lower than a maximum pressure at the separation roller 56.

The base plate 102 is a stainless steel member with a thickness of 5 mm. The base plate 102 is wedge-shaped toward a pressure contact portion between the fixing roller 51 and the separation roller 56 such that an edge portion 102*a* of the base plate 102 on a downstream side in the direction of conveyance of the recording material backs up an edge portion of the elastic layer 101 on a downstream side in the direction of conveyance of the recording material. As described above, the base plate edge portion 102*a* backs up the edge portion of the elastic layer 101, to thereby reduce an amount of a drop in pressure between the pressure pad 100 and the separation roller 56 at the fixing nip portion N.

The elastic layer 101 is made of a silicone rubber having a rubber hardness Hs of 30 degrees. The elastic layer 101 is configured such that the thickness thereof is gradually increased as compared to the thickness of the base plate 102 in a direction of movement of the fixing belt. In the first embodiment, the elastic layer 101 is shaped to have a curvature of a radius of 16 mm, and is in a shape contacting a line parallel to the base plate 102 at a nip entrance portion "a". The thickness of the rubber at the nip entrance portion "a" is 3 mm, and a peripheral length at the nip entrance portion "a" is 20 mm.

The rod 104, which is provided at the edge portion of the elastic layer 101 on the downstream side in the direction of conveyance of the recording material, increases the pressurizing force of the edge portion of the elastic layer 101 on the downstream side in the direction of conveyance of the recording material. The sliding sheet 103 covers the rod 104 to cover the elastic layer 101.

Figure 4B:
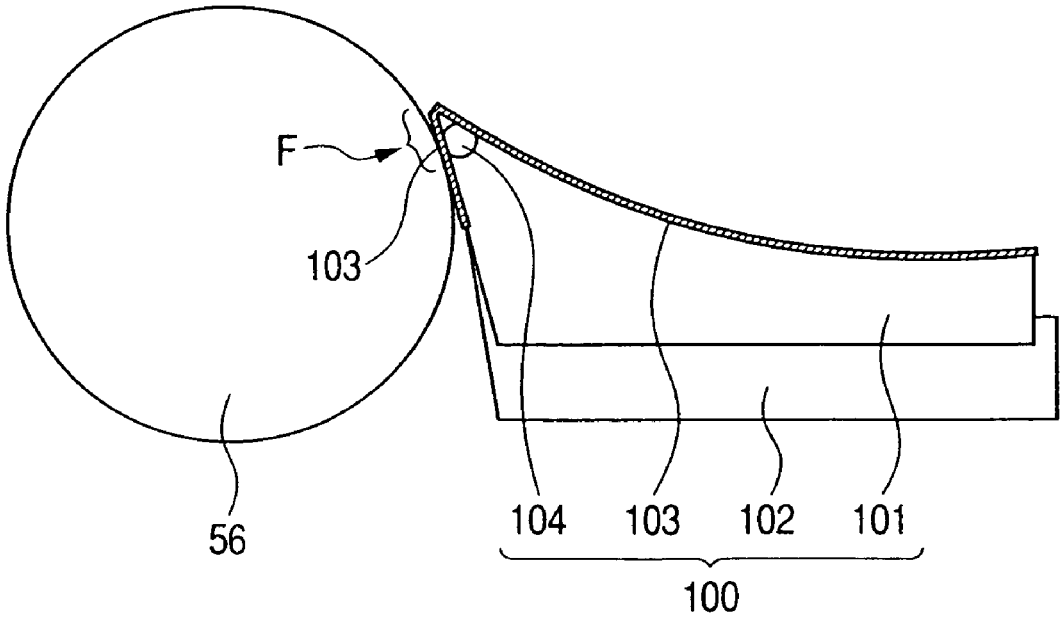

As shown in FIG. 4B, a side surface of the edge portion of the elastic layer 101 on the downstream side in the direction of conveyance of the recording material, on which the rod 104 is provided, forms a rubbing portion F with the separation roller 56 via the sliding sheet 103. The edge portion of the elastic layer 101 on the downstream side in the direction of conveyance of the recording material, on which the rod 104 is provided, is held between the separation roller 56 and the fixing roller 51 to be elastically deformed, to thereby reduce an amount of a drop in pressure between the pressure pad 100 and the separation roller 56 at the fixing nip portion N.

The fixing roller 51 is rotationally driven by a rotation mechanism (not shown). The fixing belt 52 is rotated in accordance with the rotation of the fixing roller 51. The fixing roller 51 is heated by current supplied to a heater 58, and a surface temperature of the fixing roller 51 is regulated to a predetermined fixing temperature in the rising operation. In this state, the recording material P bearing an unfixed toner image "t" is introduced into the nip entrance portion "a" of the fixing nip portion N from the entrance roller 55 side of a belt unit 53 with an image surface facing upward. The recording material P introduced into the fixing nip portion N is held between the fixing roller 51 and the fixing belt 52 to be conveyed. In the process of holding and conveying the recording material P in the fixing nip portion N, the unfixed toner image on the recording material P is brought into close contact with a surface of the fixing roller 51, fused by heat, pressed to the recording material P by the pressure of the fixing nip portion N, to thereby be fixed as a permanent fixed image.

After that, the recording material P, at a nip exit "b" of the fixing nip portion N, is naturally separated by the self stripping from the surface of the fixing roller 51 because of the inroad of the separation roller 56 into the elastic layer 51*b* of the fixing roller 51, to be delivered and conveyed.

In this embodiment, an occurrence of an excessive slippage phenomenon at the fixing nip portion N between the fixing roller 51 rotationally driven and the fixing belt 52 driven by the rotation of the fixing roller 51 is prevented. In other words, a unit 59 (FIG. 3) configured to apply a driving force to the separation roller when a rotating speed of the separation roller 56 which forms a recording material separation portion becomes a rotating speed lower than the rotating speed of the fixing belt 52 by a predetermined amount is provided.

More specifically, a one-way clutch gear is engaged with a fixing roller gear, and a first belt pulley is provided on the same axis as the one-way clutch gear. In addition, a second belt pulley is provided at an end portion of the separation roller, and the first belt pulley and the second belt pulley mentioned above are driven and connected with each other via a timing belt. The tension of the timing belt is maintained at an appropriate belt tension by a tensioner. Further, a drive train between the fixing roller and the separation roller is configured so that in a pressurized state, when the fixing belt is driven and rotated by the fixing roller, the drive is not inputted to the separation roller by a one-way clutch of the one-way clutch gear. A gear ratio is set so that the driving force from the fixing roller is inputted to the separation roller before occurrence of slippage of the fixing belt at the speed higher than the speed of the fixing roller by 4% or more, for example, when the fixing belt begins to slip on the fixing roller.

Figure 1A:
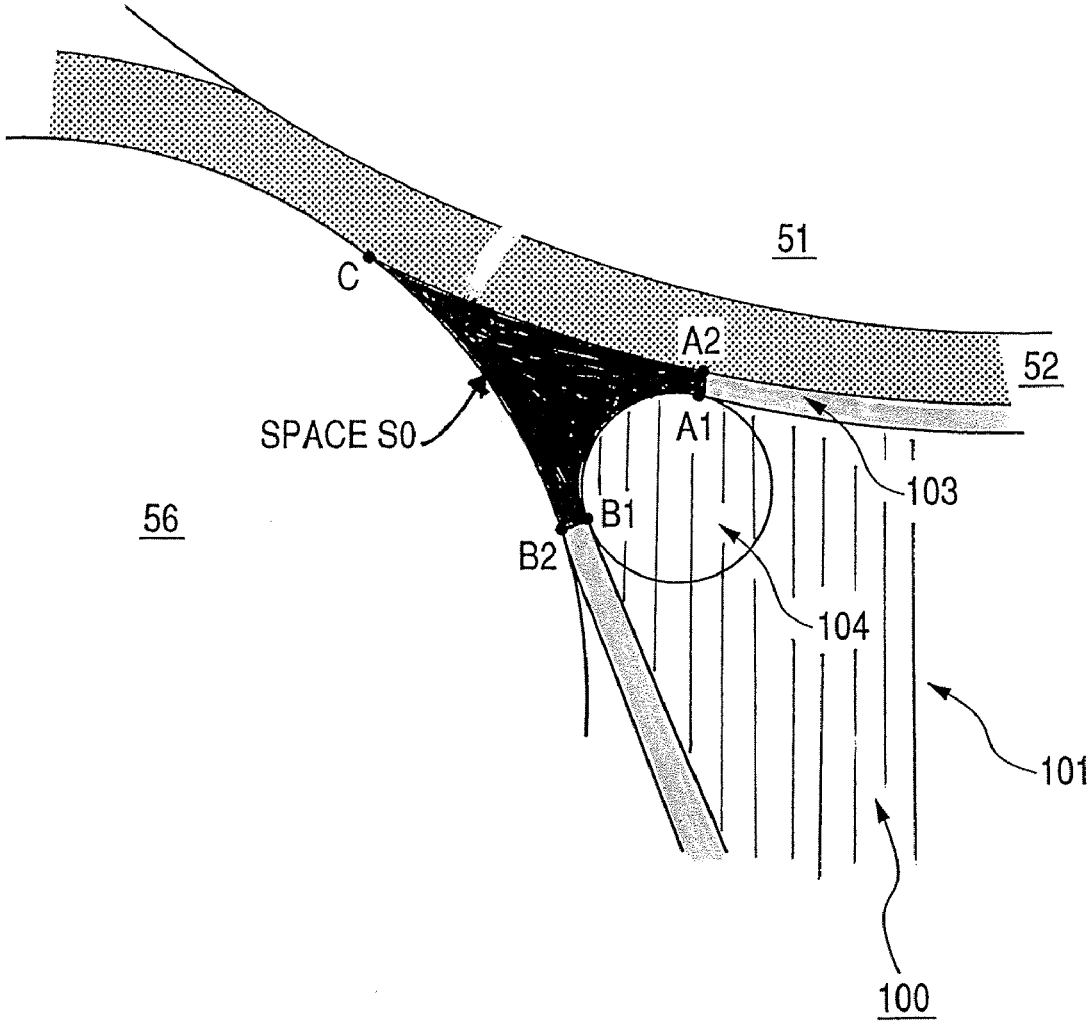
FIGS. 1A, and 1B are explanatory views of a first embodiment of the present invention.
Figure 1B:
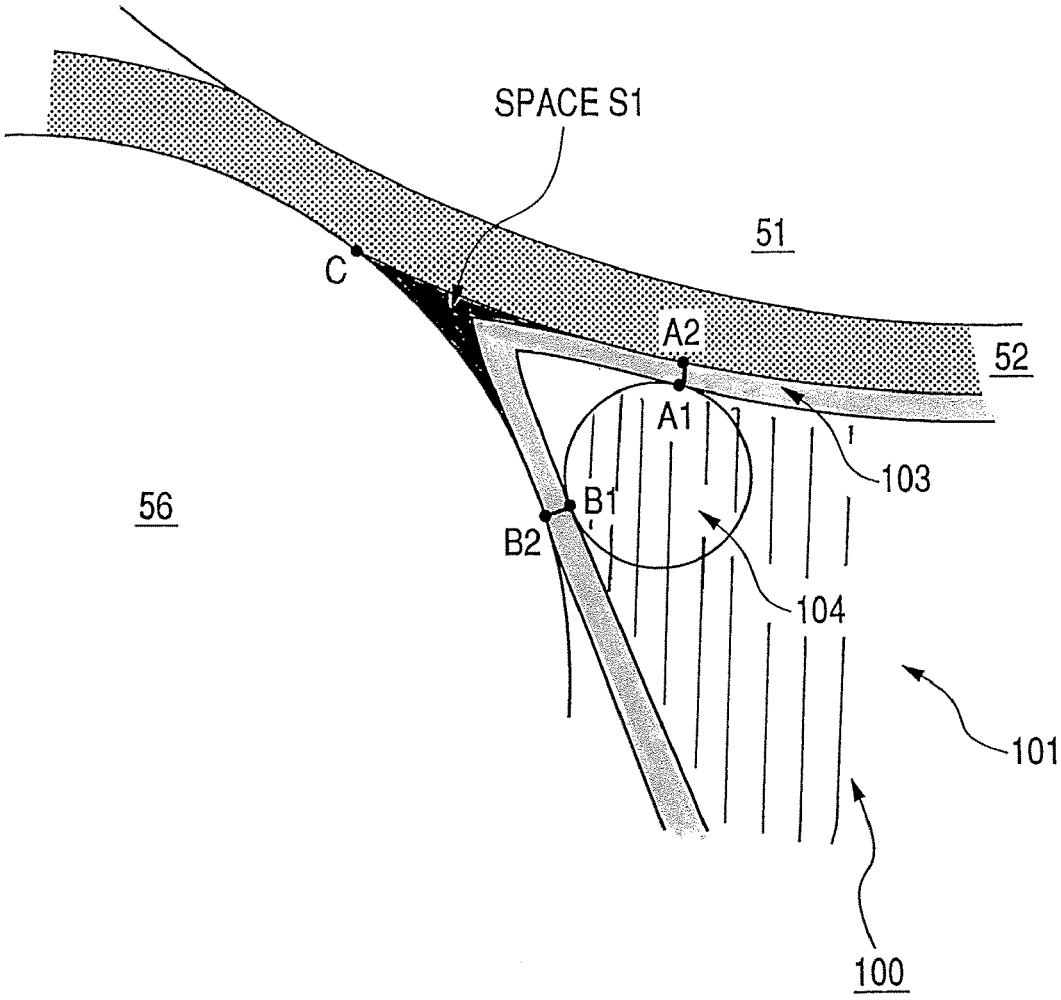

Here, a method of covering with the sliding sheet (low friction sheet) 103 at the edge portion of the pressure pad 100 which is the pressure applying member in the direction of conveyance of the recording material is as shown in FIGS. 1A and 1B.

1) On the side of the pressure pad 100 opposing the fixing roller 51, a position at which the rod 104 comes into contact with the sliding sheet 103 is A1, and a position at which the rod 104 comes into contact with the fixing belt 52 via the sliding sheet 103 is A2.

2) On the side of the pressure pad 100 opposing the separation roller 56, a position at which the rod 104 comes into contact with the sliding sheet 103 is B1, and a position at which the rod 104 comes into contact with the separation roller 56 via the sliding sheet 103 is B2.

3) On the side of the separation roller 56 opposing the fixing roller 51, a position at which the separation roller 56 comes into contact with the fixing belt 52 is C.

4) A space (a cross section of the space) formed along an outer surface of the sliding sheet 103 protruding from the positions A1 and A2 and the positions B1 and B2 and along the outer peripheral surface of the rod 104 is S.

5) A space (a cross section of the space) formed along the outer surfaces of the fixing belt 52, the separation roller 56, and the rod 104 with the positions A1, A2, B1, B2, and C being vertexes of the space is S0.

In this case, covering with the sliding sheet 103 is carried out so that a relational expression $$0.75 \leqq S/S0 < 1$$

is satisfied.

Note that when a space suffounded by the fixing belt, the separation roller, and the sliding sheet is S1 (FIGS. 1A and 1B), a relational expression $$0 < S1/S0 \leqq 0.25$$

holds between the space S0 and the space S1.

Note that a configuration in which the rod 104 is not provided at the tip of the elastic layer 101 as shown in FIG. 1 may be employed. In this case, it is preferable to make the shape of the elastic layer 101 itself almost aligned with an edge line thereof when the rod 104 as shown in FIGS. 1A and 1B is provided. Therefore, a criterion for defining the positions A1, B1, and the like mentioned above is the elastic layer 101, instead of the rod.

Each of the positions mentioned above is measured under static state in which the pressure pad which the sliding sheet covers and the separation roller are pressed at a total pressurizing force of 980 N (100 kgf) just the same as in a fixing state. In other words, each of the points of contact A1, A2, B1, B2, and C viewed from a direction of a rotational axis (the direction of the cross section) of the separation roller are determined, distances between each of the points of contact are measured, and a filling ratio S/S0 is obtained by calculating the cross sections of the spaces S and S0. The filling ratio S1/S0 is obtained in the same way as the calculation of the filling ratio S/S0.

The filling ratio S/S0 is the filling ratio of the sliding sheet 103 in relation to a space portion S0 on a back side of the belt corresponding to a portion of a boundary region of the pressure pad 100 and the separation roller 56 within a fixing nip region in which the pressure is decreased. By setting the filling ratio S/S0 to 0.75 or more (by setting the filling ratio S1/S0 to 0.25 or less), the decrease of the pressure at the portion in which the pressure is decreased is suppressed, and it is possible to prevent an image failure from occurring even when a coated paper sheet is used.

In this embodiment, the filling ratio S/S0 is set to 0.75 (the filling ratio S1/S0 is set to 0.25).

Figure 5:
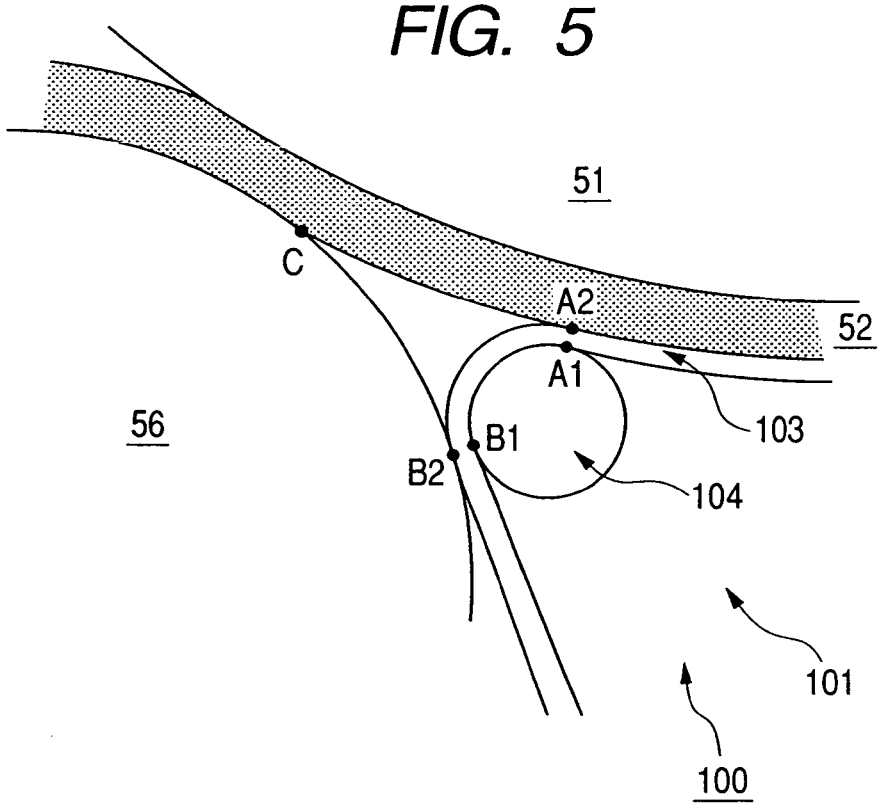
FIG. 5 is an explanatory view of the comparative example 1.
Figure 6:
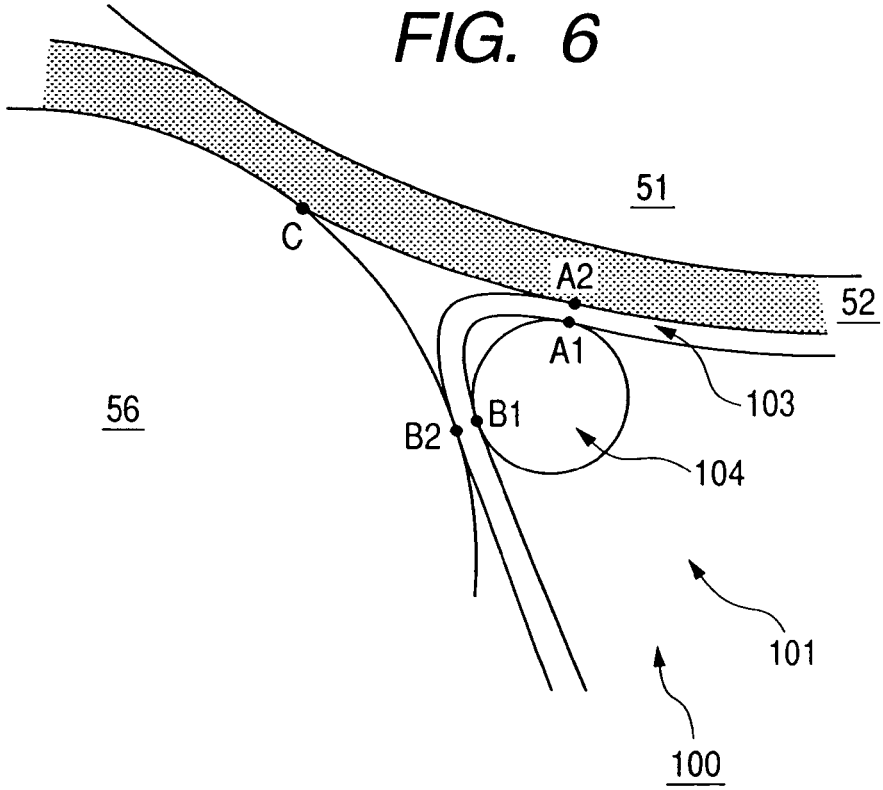
FIG. 6 is an explanatory view of the comparative example 2.

On the other hand, as a comparative examples cases as shown in FIG. 5 and FIG. 6 are verified. FIG. 5 is a comparative example 1 when the filling ratio S/S0 is set to 0.3 (the filling ratio S1/S0 is set to 0.7), and FIG. 6 is a comparative example 2 when the filling ratio S/S0 is set to 0.5 (the filling ratio S1/S0 is set to 0.5).

Fixing nip pressure distribution of each of the first embodiment and the comparative examples 1 and 2 is measured by using a tactile sensor system manufactured by NITTA CORPORATION. In the tactile sensor system, a pressure sensor element is two-dimensionally arranged on a thin film, and it is possible to measure at a 1.0 mm pitch in the direction of conveyance of the recording material and at a pitch of 6.6 mm in a direction perpendicular to a direction of conveyance of the recording material. The fixing nip pressure distribution as described below is obtained by integrating the pressure of the sensor element perpendicular to the direction of conveyance of the recording material.

Figure 2:
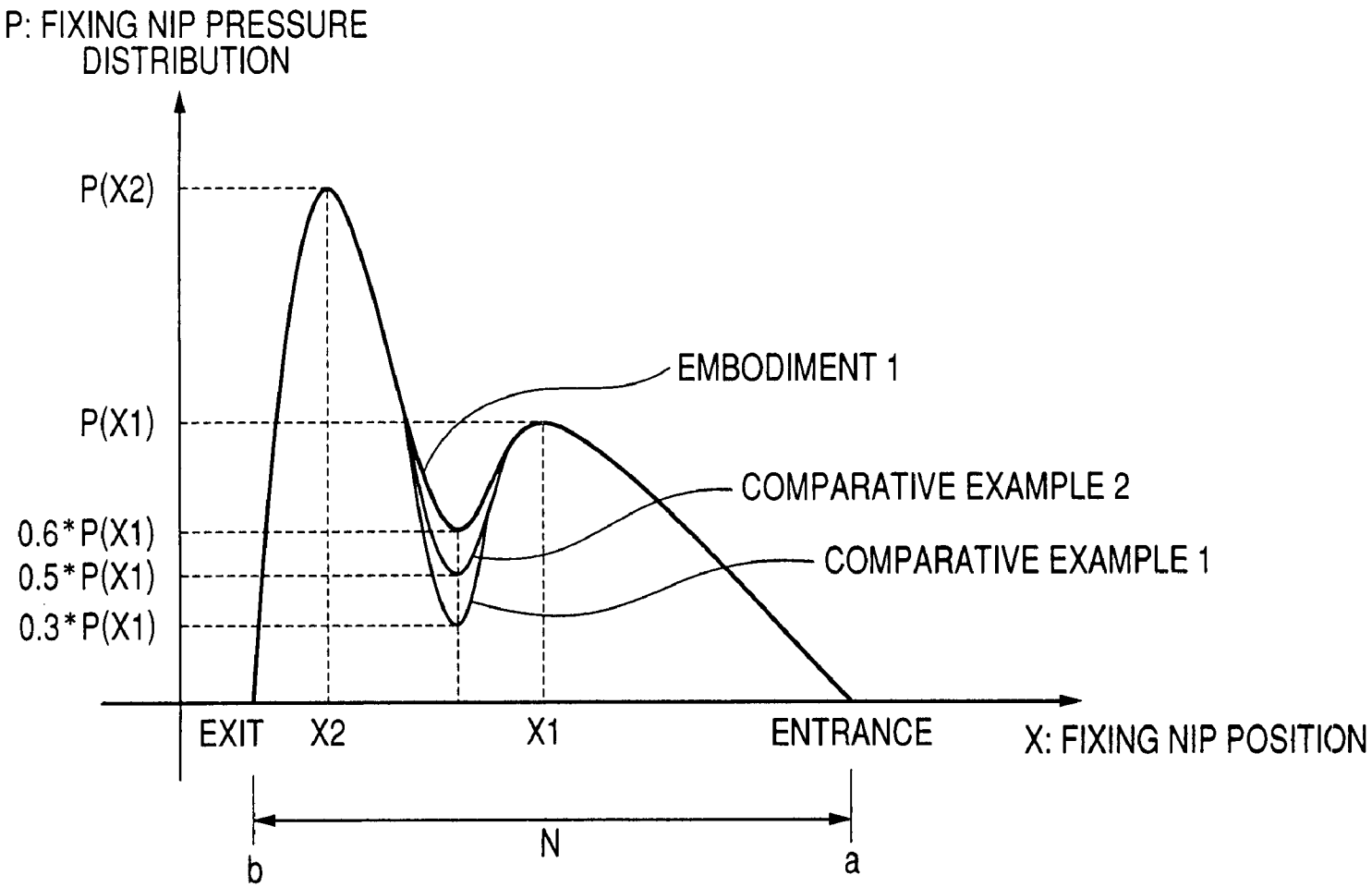
FIG. 2 is a view showing a pressure distribution of a fixing nip in each of fixing apparatuses according to the first embodiment of the present invention, a comparative example 1, and a comparative example 2.

By measuring the distributions of the first embodiment and the comparative examples 1 and 2 with the measurement system, the fixing nip pressure distribution as shown in FIG. 2 is observed for each of the first embodiment and the comparative examples 1 and 2.

That is, a substantial pressure distribution along the conveyance direction of the recording material of the fixing nip portion N is observed by taking an axis of a position x along the fixing nip, taking an axis of a pressure P along an axis perpendicular to the axis of the position x, and expressing the pressure P as a function P(x) of the position x; and a) a position at which the pressure at the nip portion formed by pressurized contact of the fixing roller 51 and the pressure pad 100 with each other via the fixing belt 52 becomes maximum is X1;

b) the pressure at the position X1 is P(X1);

c) a position at which the pressure at the nip portion formed by pressurized contact of the fixing roller 51 and the separation roller 56 with each other via the fixing belt 52 becomes maximum is X2;

d) the pressure at the position X2 is P(X2); and e) the pressure between the position X1 and the position X2 is P(X).

In this case, minimum values Pmin of P(x) are observed as the pressure as shown in Table 1.

TABLE 1

| | Pmin(X) |
|---|---|
| Comparative Example 1 | 0.3*P(X1) |
| Comparative Example 2 | 0.5*P(X1) |
| First Embodiment | 0.6*P(X1) |

A comparative experiment is carried out with the fixing apparatuses of the first embodiment and the comparative examples 1 and 2 as mentioned above.

A fixing condition is set so that a surface temperature of the fixing roller 51 is controlled to 170° C., a range of the surface temperature of the fixing belt 52 is set to be in the range of 100° C. to 150° C., and a process speed is set to 300 mm/sec.

For the condition for the recording material P to be passed and the unfixed toner, a plain paper sheet having a basis weight of 64 g/m$^2$ and an air permeability of 45 sec, the coated paper sheet having a basis weight of 105 g/m$^2$ and an air permeability of 1,000 sec, and the coated paper sheet having a basis weight of 148 g/m$^2$ and an air permeability of 20,000 sec are used. When an unfixed solid image is formed and fixed on each of the coated paper sheets, a result of a situation of occurrence of uneven glossiness as shown in Table 2 is obtained. Note that the measurement of the air permeability is conducted by the measuring method of JIS P8111.

Note that in this embodiment, the surface temperature of the fixing belt 52 is controlled to a prescribed temperature by installing a heater in the entrance roller 55 and by controlling an amount of power supplied to the heater. A unit for changing the surface temperature of the fixing belt 52 is not limited to the unit mentioned above. That is, the unit for changing the surface temperature of the fixing belt 52 may be a unit capable of raising the surface temperature in the range of 100° C. to 150° C. For example, a unit as described below may be used. That is, the fixing roller and the fixing belt are configured to abut against on and separate from each other, and the temperature of each of the fixing roller and the fixing belt is independently controlled. In this state, the fixing roller and the fixing belt are brought into contact with each other, and the paper sheet is immediately passed. Thus, it is possible to set the surface temperature to the desired temperature. In addition, for the temperature control of the fixing belt, the heater may be installed in the entrance roller 55 as described above, or otherwise it is possible to set the surface temperature to the desired temperature by controlling the fixing roller and the fixing belt to abut against and separate from each other and by receiving the heat from the fixing roller.

TABLE 2

| | Plain paper sheet 64 g/m$^2$ | Coated paper sheet 1 105 g/m$^2$ | Coated paper sheet 2 148 g/m$^2$ |
|---|---|---|---|
| Air permeability [seconds] | 45 | 1000 | 20000 |
| Comparative Example 1 | ○ | Δ | x |
| Comparative Example 2 | ○ | ○ | Δ |
| First Embodiment | ○ | ○ | ○ |

○: uneven glossiness does not occur with the fixing belt temperature of 100 to 150° C.
Δ: uneven glossiness occurs with a part of a temperature region of the fixing belt temperature of 100 to 150° C.
x: uneven glossiness occurs with almost all regions of the fixing belt temperature of 100 to 150° C.

As shown in Table 2, the result of the experiment is such that in the case of the plain paper sheet having the basis weight of 64 g/m$^2$, the uneven glossiness does not occur in all of the fixing apparatuses of the first embodiment and the comparative examples 1 and 2; and in the comparative example 1, in a case of a coated paper sheet 1, a level indicated by Δ is obtained; and in the comparative example 2, in a case of a coated paper sheet 2, a level indicated by × is obtained. As is known from Table 2, in the comparative example 2, the obtained level is improved compared to the comparative example 1, obtaining the level indicated by ○ for the coated paper sheet 1 and the level indicated by Δ for the coated paper sheet 2. In the first embodiment, the uneven glossiness does not occur both for the coated paper sheet 1 and the coated paper sheet 2.

From the results as mentioned above, it is comprehended that the level of occurrence of the uneven glossiness improves as the portion Pmin(X) at which the pressure between the separation roller 56 and the pressure pad 100 which is the pressure applying member is reduced becomes larger and that the uneven glossiness does not occur when $$P\min(X)=0.6\times P(X1).$$

Next, an experimental result that suggests air stagnation in the fixing apparatuses of the comparative example 1 and the comparative example 2 observed by the inventor of the present invention is described.

Figure 12:
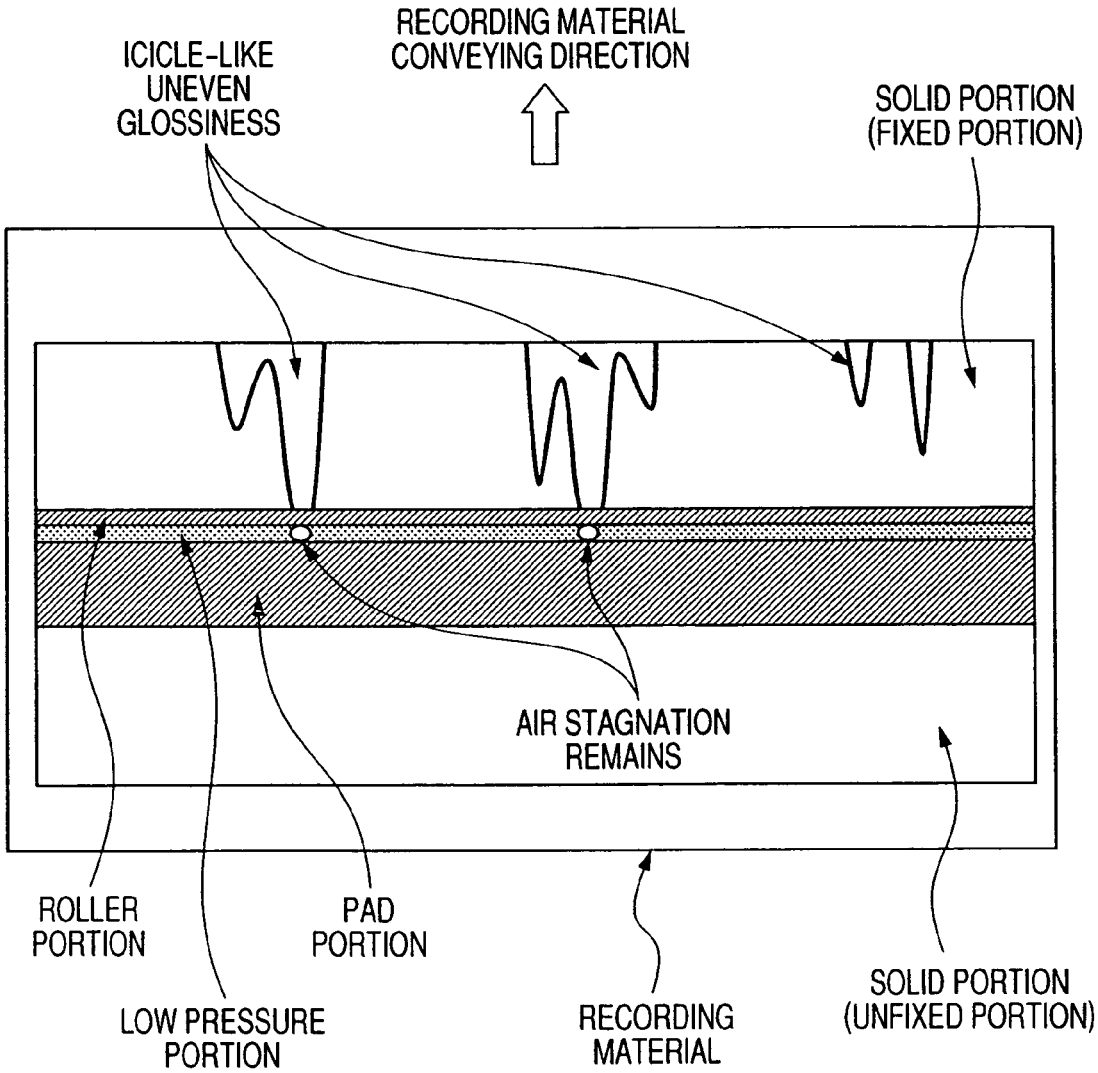
FIG. 12 is a view showing stagnation of air which causes to form the icicle-like uneven glossiness.

FIG. 12 is a view showing air stagnation remains. In this experiment, the fixing apparatus is turned off while the recording material on which a solid unfixed toner image is formed passes through the fixing apparatus. In FIG. 12, an upper side of FIG. 12 shows a fixed portion, and a lower side of FIG. 12 shows an unfixed portion. The air stagnation during the passing of the paper sheet through the fixing nip portion that is shown between the upper side and the lower side of FIG. 12 is offset at a high temperature due to overheating of the fixing apparatus caused because the fixing apparatus is turned off while the recording material on which a solid unfixed toner image is formed passes through the fixing apparatus. In this high temperature offset portion, a portion in which the high temperature offset occurs in each of a pressure pad portion (pressure applying member portion), a separation roller portion, and a portion between the pressure pad portion and the separation roller portion can be observed. In a downstream of a portion in which an icicle-like uneven glossiness occurs, and in a low pressure portion between the elastic member portion and the separation roller portion, the air stagnation remains can be observed. In addition, it is recognized that the high temperature offset does not occur because the stagnated air exists between the fixing roller 51 and the recording material P and heat is not transferred from the fixing roller 51 to the recording material P.

In accordance with the two experimental results as mentioned above, the covering with the sliding sheet 103 is carried out so that the filling ratio S/S0 is expressed by an expression $$S/S0=0.75(S1/S0=0.25).$$

Further, when the pressure between the position X1 and the position X2 is P(X), this embodiment is configured so that the pressure distribution in the fixing nip satisfies the expressions $$P(X1)\leqq P(X2)$$

$$0.6*P(X1)\leqq P(x)\leqq P(X2).$$

By using the fixing apparatus that satisfies those expressions, it is possible to prevent the stagnation of the air in an unfixed toner layer from occurring in the boundary region of the pressure pad 100 and the separation roller 56 even in a case of fixing the unfixed toner image on the paper sheet having low air permeability such as coated paper sheet.

Therefore, it is possible to prevent the phenomenon from occurring such that the glossiness differs because of the difference in heat transfer between in the air stagnation portion and in the non-air stagnation portion caused by an air gap generated partly on a boundary surface of the recording material P and the fixing roller 51 and by the inhibition of the heat transfer from the fixing roller 51 to the recording material P.

Second Embodiment

Figure 7A:
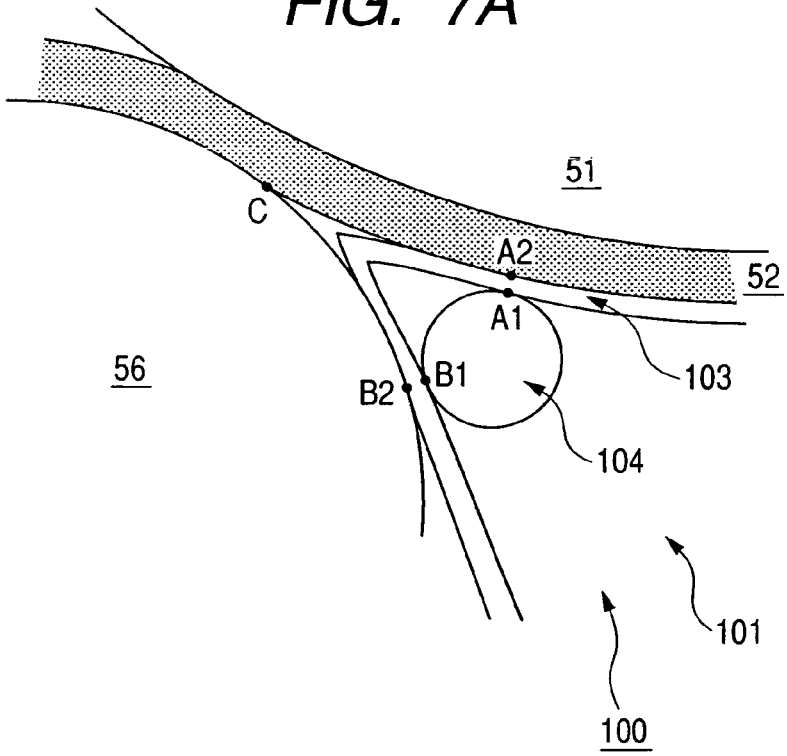
FIG. 7A and FIG. 7B are views illustrating the second embodiment of the present invention.

In a second embodiment of the present invention, a method of covering with the sliding sheet 103 is as shown in FIG. 7A. That is, the covering with the sliding sheet 103 is carried out so that the filling ratio of S/S0 of the sliding sheet 103 is expressed by an expression $$S/S0=0.80(S1/S0=0.20).$$

Other configurations are the same as the configurations of the first embodiment.

Figure 7B:
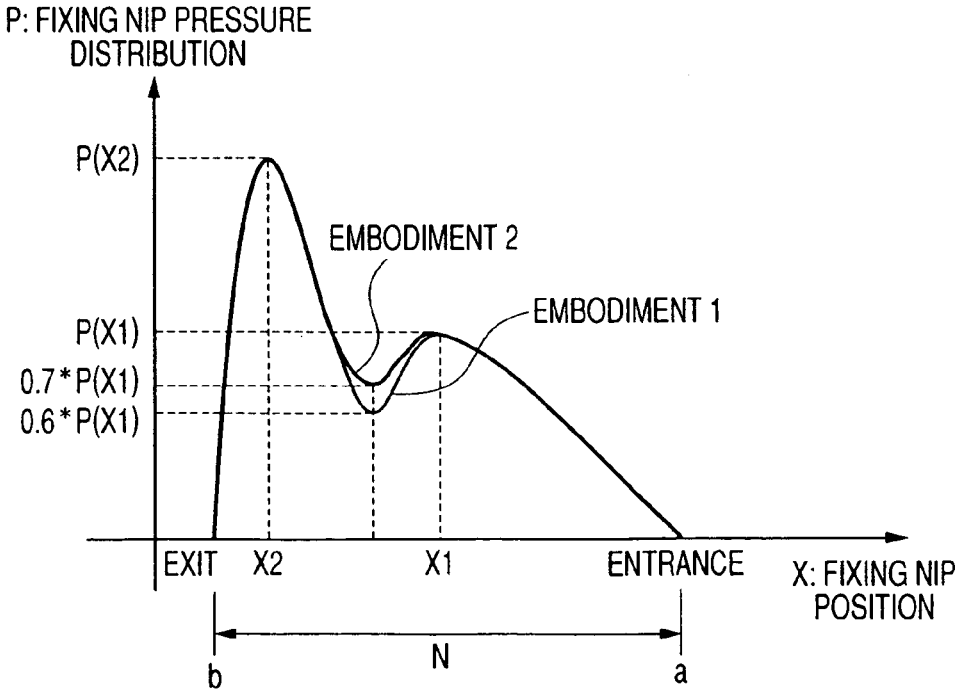

When the fixing nip pressure distribution as described in the first embodiment is measured with the above configuration, the fixing nip pressure distribution as shown in FIG. 7B is observed. In this case, when the pressure between the position X1 and the position X2 is P(X), the minimum value Pmin(X) of P(X) is expressed by the expression $$P\min(X)=0.7\times P(X1).$$

A comparative experiment as described below is carried out with the above configuration. For the fixing conditions, the surface temperature of the fixing roller 51 is controlled to 170° C. and the range of the surface temperature of the fixing belt 52 is set to be in the range of 100° C. to 150° C. Further, the process speed is set to 300 mm/sec. For the recording material P, the coated paper sheet having a basis weight of 148 g/m$^2$ and an air permeability of 20,000 sec and the coated paper sheet having a basis weight of 300 g/m$^2$ and an air permeability of 30,000 sec are used. When an unfixed solid image is formed and fixed on each of the recording materials, a result of a situation of occurrence of uneven glossiness as shown in Table 3 is obtained.

TABLE 3

| | Coated paper sheet 2 148 g/m$^2$ | Coated paper sheet 3 300 g/m$^2$ |
|---|---|---|
| Air permeability [seconds] | 20000 | 30000 |
| First Embodiment | ○ | Δ |
| Second Embodiment | ○ | ○ |

○: uneven glossiness does not occur with the fixing belt temperature of 100 to 150° C.
Δ: uneven glossiness occurs with a part of a temperature region of the fixing belt temperature of 100 to 150° C.
x: uneven glossiness occurs with almost all regions of the fixing belt temperature of 100 to 150° C.

As shown in Table 3, the result of the experiment is such that in the case of the coated paper sheet 2, the uneven glossiness does not occur in the fixing apparatuses of the first and second embodiments, and that in the case of the coated paper sheet 3 having an especially high air permeability, the level indicated by Δ is obtained in the first embodiment, and in the second embodiment, the level indicated by ○ is obtained; that is, the uneven glossiness does not occur in the second embodiment.

In accordance with the experimental result as mentioned above, the covering with the sliding sheet 103 is carried out so that the filling ratio S/S0 is expressed by an expression $$S/S0=0.80(S1/S0=0.20).$$

Further, when the pressure between the position X1 and the position X2 is P(X), this embodiment is configured so that the pressure distribution in the fixing nip satisfies the expressions $$P(X1)\leqq P(X2)$$

$$0.7*P(X1)\leqq P(x)\leqq P(X2).$$

By using the fixing apparatus that satisfies those expressions, it is possible to prevent the stagnation of the air in an unfixed toner layer from occurring in the boundary region of the pressure pad 100 and the separation roller 56 even in a case of fixing the unfixed toner image on the paper sheet having particularly low air permeability such as thick coated paper sheet.

Therefore, it is possible to prevent the phenomenon from occurring such that the glossiness differs because of the difference in the heat transfer between in the air stagnation portion and in the non-air stagnation portion caused by an air gap generated partly on a boundary surface of the recording material P and the fixing roller 51 and by the inhibition of the heat transfer from the fixing roller 51 to the recording material P.

Third Embodiment

Figure 8A:
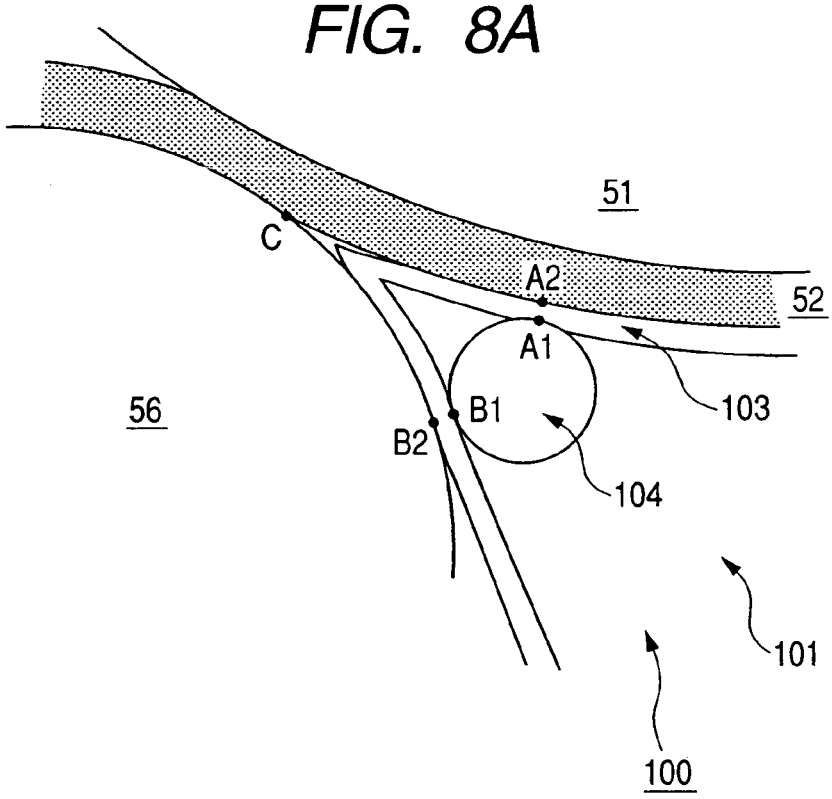
FIG. 8A and FIG. 8B are views illustrating the third embodiment of the present invention.

In a third embodiment of the present invention, a method of covering with the sliding sheet 103 is shown in FIG. 8A. That is, the covering with the sliding sheet 103 is carried out so that the filling ratio of S/S0 of the sliding sheet 103 is expressed by an expression $$S/S0=0.85(S1/S0=0.15).$$

Other configurations are the same as the configurations of the first embodiment.

Figure 8B:
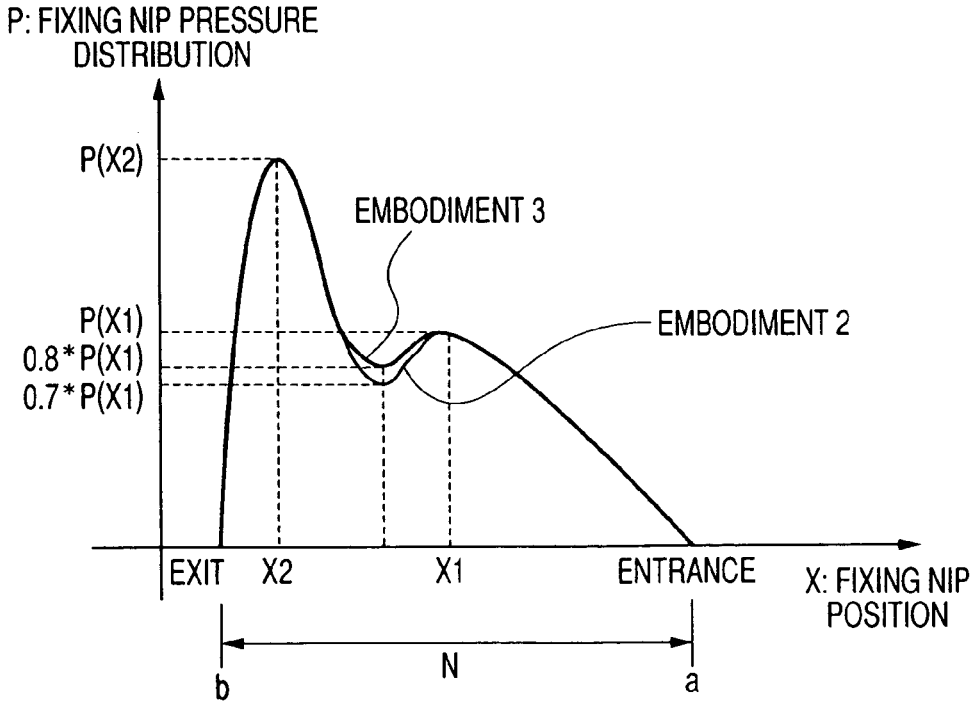
Figure 9:
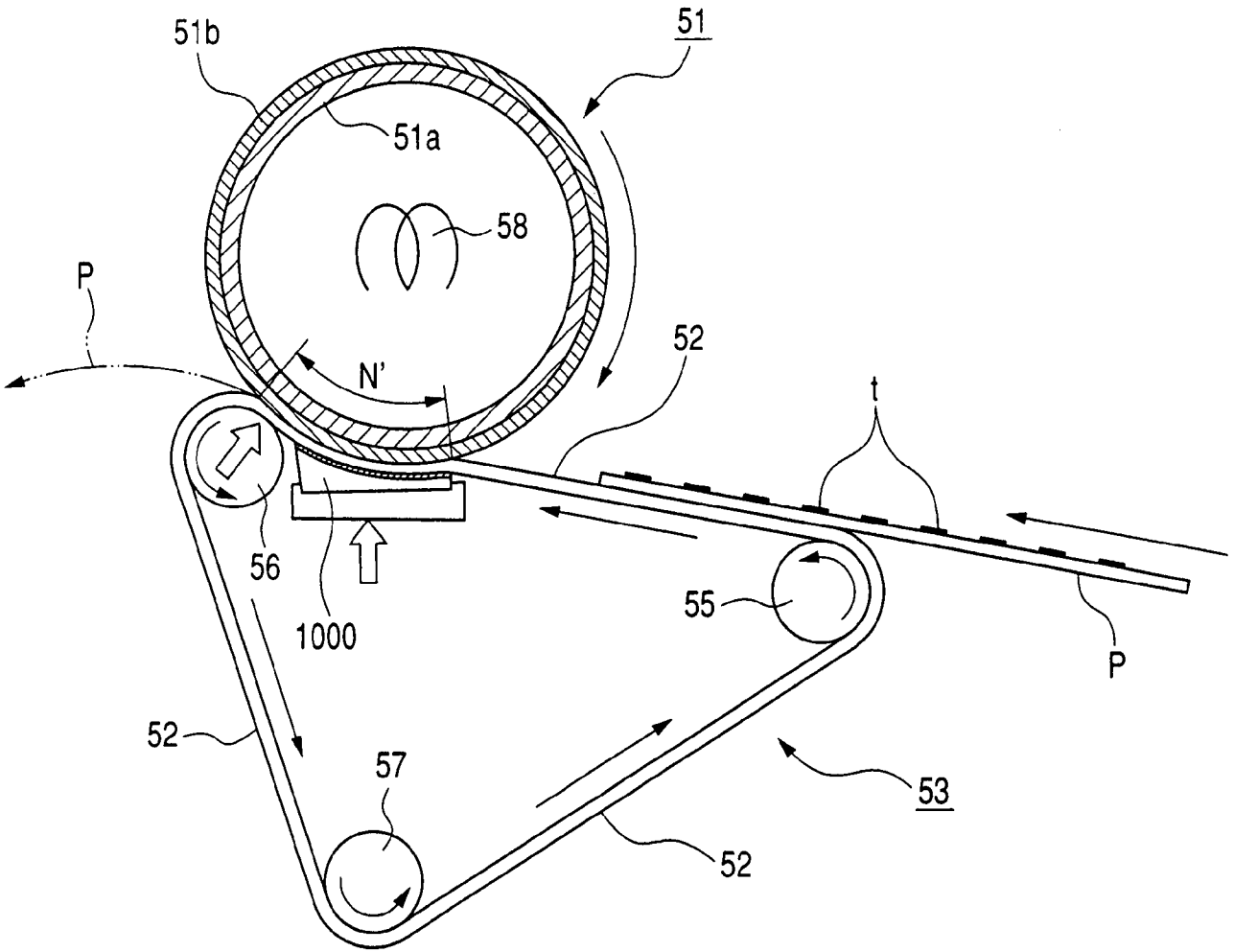
FIG. 9 is an explanatory view of a configuration of a belt nip type fixing apparatus according to a conventional example.
Figure 10:
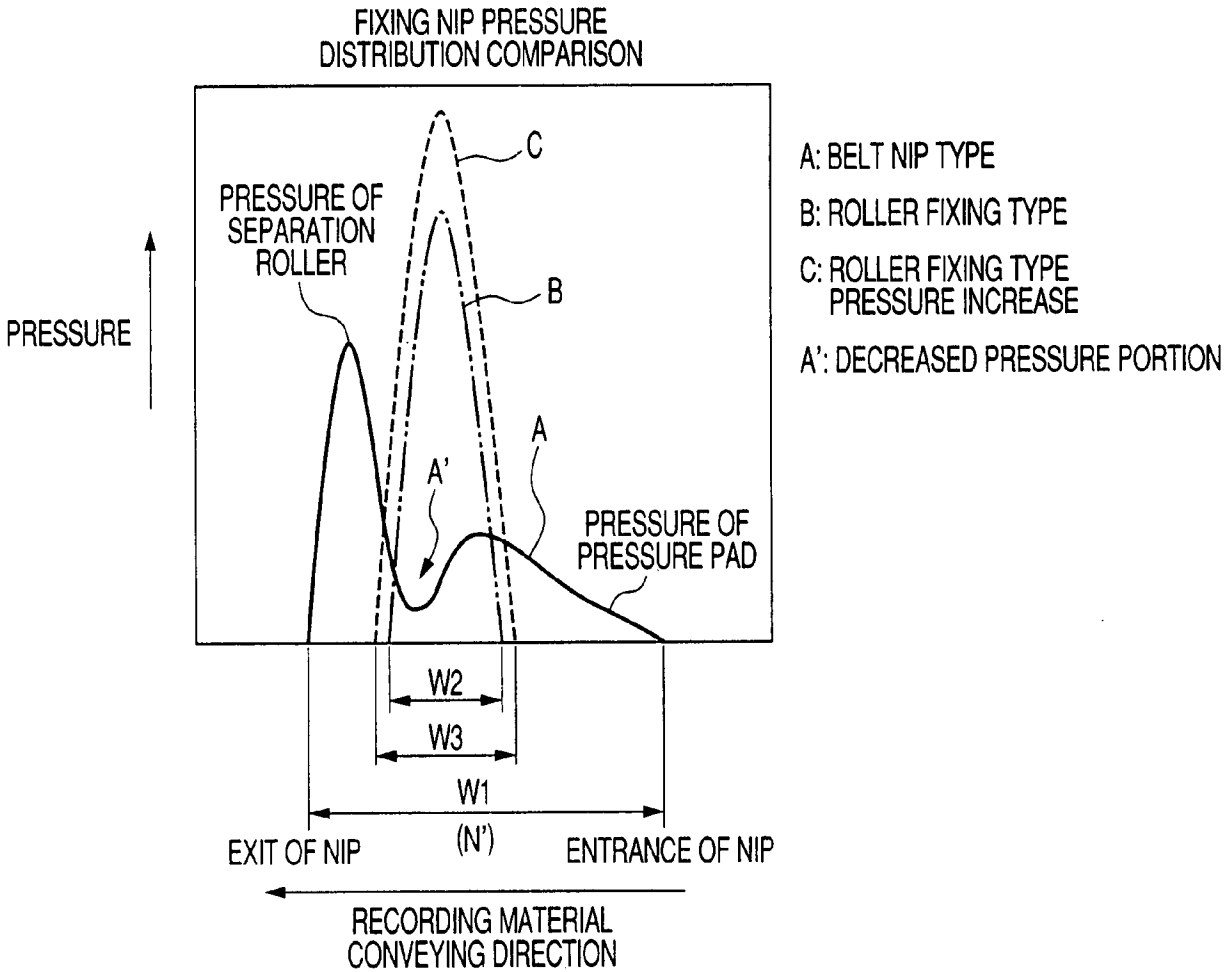
FIG. 10 is an explanatory view showing a comparison between the pressure distribution of the fixing nip of a roller type fixing apparatus and the pressure distribution of the fixing nip of the belt nip type fixing apparatus according to the conventional example.
Figure 11:
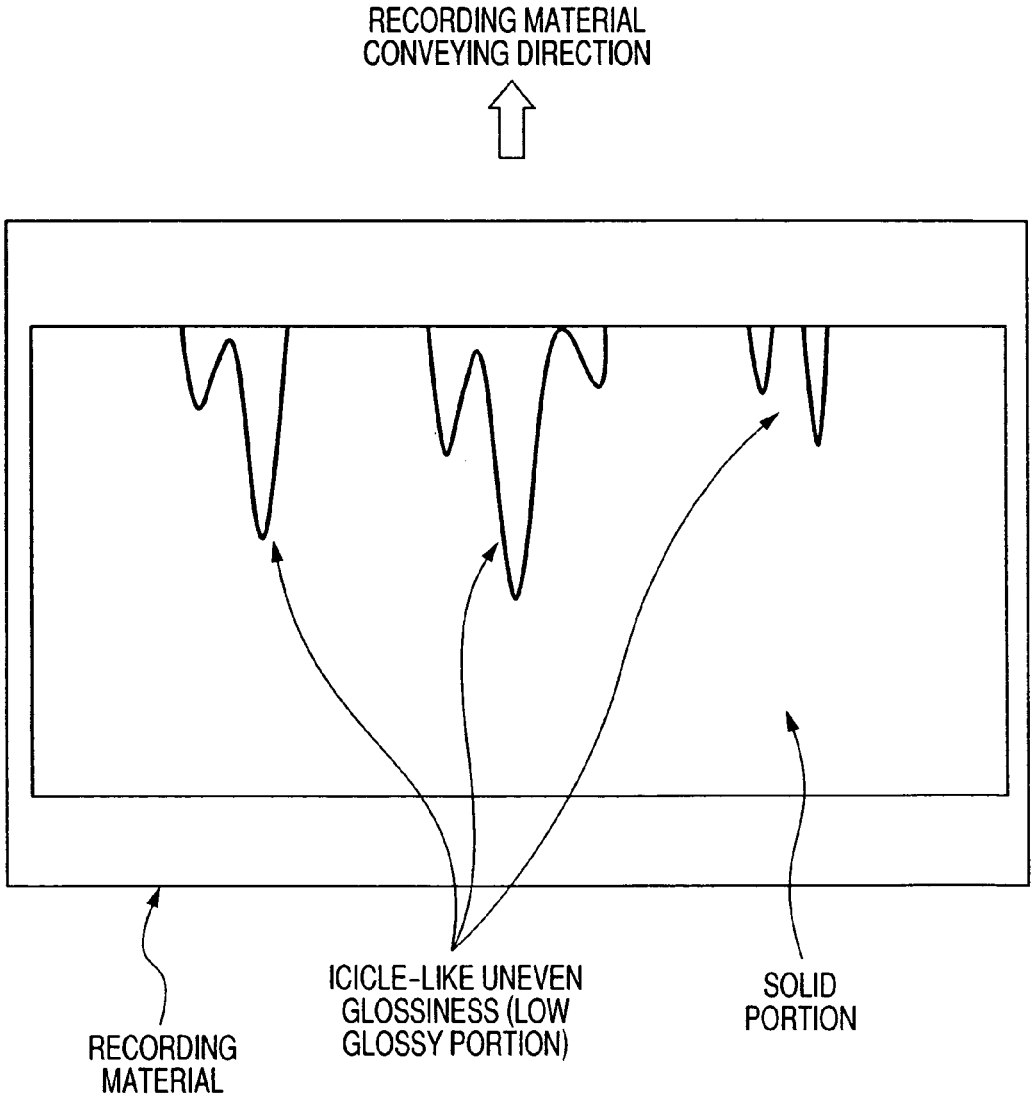
FIG. 11 is a view showing an icicle-like uneven glossiness in an image failure.

When the fixing nip pressure distribution as described in the first embodiment is measured with the above configuration, the fixing nip pressure distribution as shown in FIG. 8B is observed. At this time, when the pressure between the position X1 and the position X2 is P(X), the minimum value Pmin(X) of P(X) is expressed by the expression $$P\min(X)=0.8\times P(X1).$$

A comparative experiment as described below is carried out with the above configuration. For the fixing conditions, the surface temperature of the fixing roller 51 is controlled to 170° C. and the range of the surface temperature of the fixing belt 52 is set to be in the range of 100° C. to 150° C. Further, the process speed is set to 300 mm/sec.

The environmental conditions in this case are set to 23° C./50% RH and 23° C./80% RH. For the recording material to be passed, the coated paper sheet having an air permeability of 30,000 sec and a basis weight of 300 g/m$^2$ is used. When an unfixed solid image is formed and fixed on the coated paper sheet, a result of a situation of occurrence of uneven glossiness as shown in Table 4 is obtained.

TABLE 4

| | Environment 1 23° C./50% RH | Environment 2 23° C./80% RH |
|---|---|---|
| Second Embodiment | ○ | Δ |
| Third Embodiment | ○ | ○ |

○: uneven glossiness does not occur with the fixing belt temperature of 100 to 150° C.
Δ: uneven glossiness occurs with a part of a temperature region of the fixing belt temperature of 100 to 150° C.
x: uneven glossiness occurs with almost all regions of the fixing belt temperature of 100 to 150° C.

As shown in Table 4, the result obtained through the experiment is as follows. In the case of the environment 1, the uneven glossiness does not occur in the fixing apparatuses according to the first embodiment and the second embodiment. On the other hand, under a high humidity condition of 80% RH, the level indicated by Δ is obtained in the second embodiment, while in the third embodiment, the level indicated by ○ is obtained; that is, the uneven glossiness does not occur in the third embodiment.

In accordance with the experimental result as mentioned above, the covering with the sliding sheet 103 is carried out so that the filling ratio S/S0 is expressed by an expression $$S/S0=0.85(S1/S0=0.15).$$

Further, when the pressure between the position X1 and the position X2 is P(X), this embodiment is configured so that the pressure distribution in the fixing nip satisfies the expressions $$P(X1)\leqq P(X2)$$

$$0.8\times P(X1)\leqq P(x)\leqq P(X2).$$

By using the fixing apparatus that satisfies those expressions, it is possible to prevent the image failure from occurring even in a case of fixing the unfixed toner image on the thick coated paper sheet having an especially low air permeability under a high humidity environment. Therefore, it is possible to prevent the phenomenon in which a heat transfer from the fixing roller 51 to the recording material P is inhibited, generating a difference in the heat transfer between in the air stagnation portion and in the non-air stagnation portion, leading to the different glossiness.

According to each of the embodiments described above, the space (cross section) surrounded by the fixing belt, the pressure pad, and the separation roller in the fixing nip region is adequately filled by the sliding sheet, to thereby reduce an amount of a drop in the pressure in the space.

Accordingly, the air is not stagnated in the portion of the space like this, and it is possible to suppress the occurrence of the image failure even in the case where the coated paper sheet or the like is used as the recording material.

More specifically, in the case of fixing the unfixed toner image on the recording material having a low air permeability such as the coated paper sheet, it is possible to suppress the uneven glossiness of the image from being caused by an inhibition of the heat transfer from the fixing roller to the recording material in the portion of the space like this.

This application claims priority from Japanese Patent Application Nos. 2004-305793 filed on Oct. 20, 2004 and 2005-233276 filed on Aug. 11, 2005, which are hereby incorporated by reference herein.

What is claimed is:

1. An image heating apparatus, comprising:

a heat rotary member, which heats an image on a recording material at a heating nip;

an endless belt, which forms the heating nip between the endless belt and the heat rotary member;

a roller, which presses the endless belt toward the heat rotary member at the heating nip;

a pad, which presses the endless belt toward the heat rotary member at the heating nip; and a sheet, which covers the pad and which is slidable on the endless belt, wherein the following relationship is satisfied:

$$0<S1/S0\leqq 0.25,$$

where

S0: a cross-section of a space formed with points A1, A2, B1, B2, and C in an area surrounded by the belt, the roller, and the pad, where A1: a boundary point at which the pad and the sheet start to separate, A2: a point corresponding to A1 on the opposite side of the sheet, irrespective of the thickness of the sheet;

B1: another boundary point at which the pad and the sheet start to separate, B2: a point corresponding to B1 on the opposite side of the sheet, irrespective of the thickness of the sheet, and C: a position at which the roller contacts the endless belt, and S1: a cross-section of a space surrounded by the belt, the roller, and the sheet.

2. An image heating apparatus according to claim 1, wherein the pad includes:

an elastic member; and a rod-shaped member provided at a downstream end of the elastic member in a direction of conveyance of the recording material.

3. An image heating apparatus according to claim 1, wherein the following relationships are satisfied:

$$P(X1)\leqq P(X2),$$

and $$0.6\times P(X1)\leqq P(X)\leqq P(X2),$$

where

P: a pressure in a position X in the direction of conveyance of the recording material in the heating nip, X1: a position in which the pressure applied by the pad becomes maximum, P(X1): the pressure in the position X1, X2: a position in which the pressure applied by the roller becomes maximum, P(X2): the pressure in the position X2, and P(X): a pressure in the position X between the position X1 and the position X2.

4. An image heating apparatus according to claim 1, wherein the sheet is made of resin.

5. An image heating apparatus according to claim 1, wherein the image heating apparatus fixes an unfixed image on the recording material.

* * * * *

UNITED STATES PATENT AND TRADEMARK OFFICE

CERTIFICATE OF CORRECTION

PATENT NO. : 7,260,353 B2
APPLICATION NO. : 11/244082
DATED : August 21, 2007
INVENTOR(S) : Taichi Takemura It is certified that error appears in the above-identified patent and that said Letters Patent is hereby corrected as shown below:

COLUMN 1:
Line 39, “thermister” should read --thermistor--.
Line 40, “thermister” should read --thermistor--.

COLUMN 2:
Line 2, “without” should read --while--.
Line 3, “less” should read --little--.

COLUMN 3:
Line 18, “FIGS. 1A,” should read --FIGS. 1A--.

COLUMN 7:
Line 20, “suffounded” should read --surrounded--.
Line 59, “examples” should read --example,--.

COLUMN 8:
Line 53, “and” should read --with--.

Signed and Sealed this

Twenty-fifth Day of March, 2008

JON W. DUDAS
*Director of the United States Patent and Trademark Office*

UNITED STATES PATENT AND TRADEMARK OFFICE

CERTIFICATE OF CORRECTION

PATENT NO. : 7,260,353 B2
APPLICATION NO. : 11/244082
DATED : August 21, 2007
INVENTOR(S) : Taichi Takemura It is certified that error appears in the above-identified patent and that said Letters Patent is hereby corrected as shown below:

COLUMN 1:
Line 39, “thermister” should read --thermistor--.
Line 40, “thermister” should read --thermistor--.

COLUMN 2:
Line 2, “without” should read --while--.
Line 3, “less” should read --little--.

COLUMN 3:
Line 18, “FIGS. 1A,” should read --FIGS. 1A--.

COLUMN 7:
Line 20, “suffounded” should read --surrounded--.
Line 59, “examples” should read --example,--.

COLUMN 8:
Line 53, “and” should read --with--.

Signed and Sealed this

First Day of April, 2008

JON W. DUDAS
*Director of the United States Patent and Trademark Office*